US005668583A

United States Patent [19]

Thiel et al.

[11] Patent Number: 5,668,583

[45] Date of Patent: Sep. 16, 1997

[54] INK PRINTER HEAD COMPOSED OF INDIVIDUAL INK PRINTER MODULES

[75] Inventors: Wolfgang Thiel; Junming Zhang, both of Berlin, Germany

[73] Assignee: Francotyp-Postalia AG & Co., Birkenwerder, Germany

[21] Appl. No.: 494,072

[22] Filed: Jun. 23, 1995

[30] Foreign Application Priority Data

Jul. 5, 1994 [DE] Germany ..... 44 24 770.0

[51] Int. Cl.[6] ..... B41J 2/045

[52] U.S. Cl. ..... 347/71

[58] Field of Search ..... 347/40, 42, 70, 347/71

[56] References Cited

U.S. PATENT DOCUMENTS 4,330,787 5/1982 Sato et al. ..... 347/63
4,769,654 9/1988 Tanaka et al. .

FOREIGN PATENT DOCUMENTS 0 067 653 6/1982 European Pat. Off. .
26 49 970 5/1978 Germany .

*Primary Examiner*—Joseph W. Hartary
*Assistant Examiner*—L. Anderson
*Attorney, Agent, or Firm*—Hill, Steadman & Simpson

[57] ABSTRACT

An ink printer head of individual ink printer modules operating according to the edge-shooter principle equipped with piezoelectric actuators is provided for use in printers for postage meter machines and correspondingly has a large number of nozzles arranged in columns. For this purpose, a nozzle module, composed of a nozzle plate and two adapter plates arranged at opposite sides thereof, is disposed between ink printer modules that are constructed mirror-symmetrically relative to one another and are equipped with piezoactuators applied on both sides. The adapter plates are provided with openings for ink guidance and with recesses providing for the free space needed for piezoactuators. The openings in the adapter plates are matched, first, to the nozzle dimensions and, second, to the dimensions of the connecting channels to the ink chambers and are aligned with both the nozzles and the connecting channels. Identical etching masks can be used for a number of plates due to the mirror-symmetrical structure. A reduction in the manufacturing outlay while preserving the requiring printing precision is achieved. A high degree of repetition is achieved by employing identical ink printer modules and ink paths of approximately identical length is also achieved. The nozzle apertures can be given a circular cross-section without difficulty.

9 Claims, 6 Drawing Sheets

INK PRINTER HEAD COMPOSED OF INDIVIDUAL INK PRINTER MODULES

BACKGROUND OF THE INVENTION

1. Field of the Invention

The present invention is directed to an ink printer head of the type composed of a stacked ink printer modules operating according to the edge-shooter principle and that are equipped with ink ejecting piezoelectric actuators.

2. Description of the Prior Art

Ink printer head of the above-described type are used in small, fast printers that are in turn a component of modern machines for franking postal matter or for printing addresses.

Differing from a standard office printer with line-by-line imprinting, the printing ensues in such smaller machines as a one-time franking imprint in one pass of the postal matter. The printing width determines the number of nozzles to be arranged in one column of the nozzle matrix, and thus also determines one dimension of the ink printer head. The capability of printing blocks having word and image characters is a feature available using such postage meter machines. Printer resolutions of approximately 200 dpi are required for assuring a good printing quality. This requires nozzle apertures having a width of 40 through 50 μm. High demands are thus made on the precision of the nozzle division and the drive thereof. Given a standard block width of one inch, the adjustment error must be kept below 10 μm.

German OS 42 25 799 discloses an ink printer head of the type initially described that is composed of a number of different modules, only one module thereof carrying the shared nozzle row at its end face. All modules have pressure chambers driveable by piezoactuators for ink ejection that are connected to the allocated nozzles via appropriately conducted channels. The connecting channels from module to module necessarily proceed orthogonally relative to the pressure chambers.

Although the advantage of only a single nozzle row is significant, the technological outlay for manufacturing the modules that differ from one another is still substantial.

Higher precision than that for the pressure chambers and a higher adjustment outlay are required for the connecting channels that proceed through a number of modules. The fact that the connecting channels have different lengths causes additional control problems. Although the advantage of only a single nozzle row is significant, the technological outlay for manufacturing the modules that differ from one another is still considerable.

German OS 26 49 970 also discloses an ink printer head that is composed of sandwiched individual, smooth plates having the same size. Successively arranged at both sides of a nozzle plate are an intermediate plate, two channel plates, a membrane plate and—at the outside thereof—piezoactuators.

The nozzle plate has one end face provided with tooth-like cut-outs that represent the nozzles or, respectively, nozzle apertures; compensation chambers or, respectively, recesses are present in the part of the nozzle plate lying therebehind for the purpose of decoupling the ink pressure chambers lying at both sides of the nozzle plate.

The intermediate plates has openings for the ink flow to the nozzles.

Ink or energy flow channels to the nozzles and admission channels for ink from an ink reservoir are located in the channel plates in the form of openings therein.

The pump plates have openings in registration with the compensation chambers in the nozzle plate, one part of these openings serving as a pump space and the other part serving as an ink flow channel.

In addition to their above-described function, the membrane plates serve the purpose of closing the system and also serve as a carrier for the piezoactuators.

The described arrangement essentially represents an ink printer head composed of two ink printer modules that are constructed mirror-symmetrically relative to one another and which share a nozzle plate. Piezoactuators are secured only at the two outside walls and piezoactuators that lie opposite one another are simultaneously driven.

Although the outlay of eleven plates is rather substantial, printer resolutions of only 24 dpi are achieved with this ink printer head because of the structure as well as due to the operating mode. A resolution of 192 dpi, however, is required for the above-described use in a franking machine.

SUMMARY OF THE INVENTION

An object of the present invention is to reduce the manufacturing outlay while preserving the required printing precision in a print head suitable for use in a small franking machine.

Another object of the present invention is to provide an ink printer head of the type initially described wherein, while retaining the principle of a single nozzle row, the number of different ink printer modules or components is substantially reduced and wherein the ink paths from the pressure chambers to the nozzles are of approximately equal length.

The above object is achieved in accordance with the principles of the present invention in an ink printer head composed of an edge shooter nozzle module disposed between and aligned with a pair of mirror-symmetrically constructed ink printer modules, the ink printer modules having ink chambers therein respectively operated by piezoactuators. The nozzle module includes a nozzle plate having a comb-like toothed edge with gaps facing toward a front of the ink printer head, and two adapter plates disposed at opposite sides of the nozzle plate. Each of the adapter plates has openings therein corresponding in number to the number of ink chambers, and recesses for the piezoactuators. The recesses for the piezoactuators project into the adapter plates from respective sides thereof facing the ink printer modules. The gaps in the comb-like edge of the nozzle plate form the nozzle apertures, and are disposed equidistantly beneath each other in a column. The adapter plates disposed at opposites sides of the nozzle module, between the nozzle module and the ink printer modules, each having openings therein which connect the nozzle apertures in alternation to ink chambers in the ink printer modules on opposite sides of the nozzle module. Thus, the topmost nozzle aperture in the nozzle module is supplied with ink from an ink chamber in the ink printer module on one side of the nozzle module the penultimate nozzle aperture is supplied with ink from an ink chamber in the ink printer module on the opposite side of the nozzle module, etc.

A number of advantages are achieved by the inventive arrangement.

A compact printer head structure in stacked format is achieved with high packing density. Adjustment problems are minimized with the stacked structure.

The desired print density of 192 dpi can be achieved in two ways.

When the ink printer head has its nozzle row arranged orthogonally to the moving direction of the recording medium, then the module length, or plate length, at the front side is limited to the printing width of one inch, and thus a maximum of 48 ink pressure chambers can be achieved per module. Consequently, two ink printer modules, between which a correspondingly dimensioned spacer plate is to be inserted, must be provided at each side of the nozzle module.

When the ink printer head can be arranged with its nozzle row at a slant, for example at an angle of 30° relative to the moving direction of the recording medium, then the module length, or plate length, at the front side can be doubled to two inches and 96 ink pressure chambers can thus be achieved per module. Consequently, only one ink printer module need be provided at each side of the nozzle module.

Except for the outwardly terminating cover plates, for which no additional processing is required, all plates can be manufactured with high precision using a lithography technique. The openings, the nozzle apertures or the nozzles, the ink chambers and the ink channels can be produced in the same way. Suitable technologies are etching, laser drilling, sand blasting or LIGA technique. Punching as well as spark erosion are also be suitable when the plates are steel. A complicated monitoring of the etching depth is eliminated.

The adapter plate fulfills a number of functions:

- mechanical and fluid connection between ink printer module and nozzles;
- spatial matching between larger ink channels or the openings leading to these and to smaller nozzle apertures, as well as setting their spatial offset relative to one another;
- reduction of 2n columns of ink chambers to one column of nozzles;
- spacer between nozzle plate and piezoactuators.

The problem areas of printer resolution and the precision of the nozzle division (equidistance) and nozzle shape has been displaced away from the modules themselves to the combination composed of the adapter plate and nozzle plate and can be governed at those components without difficulty on the basis of lithography technique.

The disclosed structure of the ink printer modules composed of a first cover plate, an intermediate plate, a separating plate, another intermediate plate and a second cover plate makes it possible to dispose the ink chambers either in the cover plate or in the intermediate plate. The offset of the ink chambers at both sides of the intermediate plates with a mismatch and the plate itself effect a good acoustic decoupling within a module.

Given more than one ink printer module at both sides of the nozzle module, a good acoustic decoupling is achieved by the spacer plate arranged between the nozzle module and the ink printer module.

The adapter plates and spacer plates are expediently provided with recesses for the piezoactuators and their electrical leads; these recesses are expediently open toward the back side.

The nozzle plate can be provided with recesses in the same way for improving the accessibility to the piezoactuators.

The ink chambers lying closer to the nozzle module are set back to such an extent from the side that ink paths having the same length as in the case of ink chambers lying farther toward the outside are present. Identical operating conditions are thus also achieved and corrective control measures are not needed.

The connection of the plates of a module to one another can advantageously ensue with thermal bonding. The connection of the modules to one another can preferably ensue with UV-activatable adhesive previously applied in the lithography technique.

Thermal actuators within the ink chambers can be used instead of the piezoactuators. The force required for ink ejection is then produced not by diminishing the chamber volume but as a result of the rapid evaporation pressure of an appropriate component of the ink.

DESCRIPTION OF THE PREFERRED EMBODIMENTS

Figure 1:
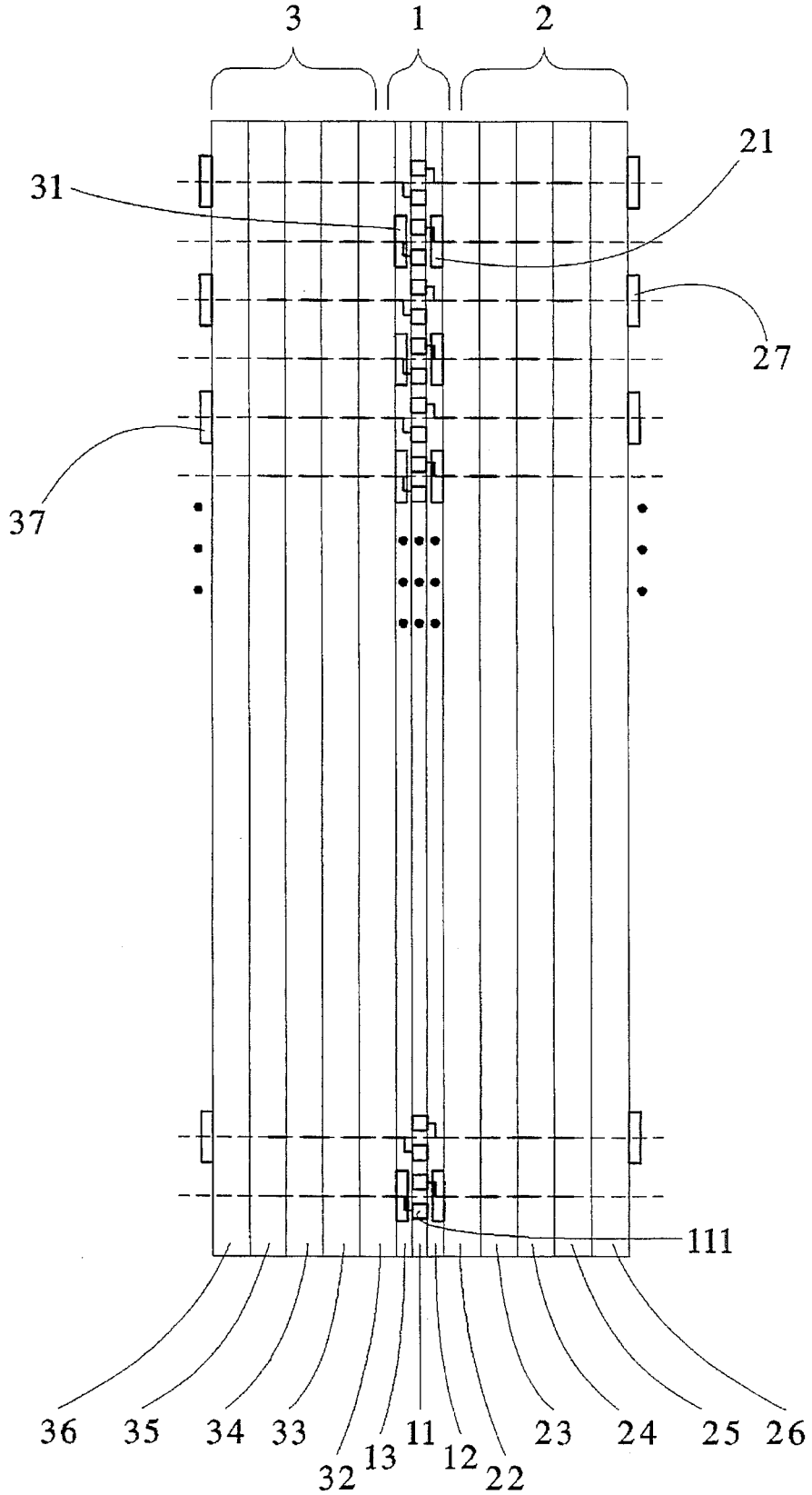
FIG. 1 is a schematic front view of an ink printer head composed of a nozzle module and two ink printer modules.

A shown in FIG. 1, an ink printer head is composed of a nozzle module 1 and two ink printer modules 2 and 3 that are arranged and constructed mirror symmetrically relative to the nozzle module 1. The ink printer modules 2 and 3 are provided with piezoactuators 21, 27, 31 and 37 disposed at both sides (also see FIG. 2).

The nozzle module 1 is composed of a nozzle plate 11 and two adapter plates 12 and 13 respectively disposed at opposite sides thereof. The adapter plates 12 and 13 are provided with openings 121 and 131 corresponding in number to the number of ink chambers 232, 252 and 332, 352 respectively in the ink printer modules 2 and 3. Further, the adapter plates 12 and 13 have recesses 122 and 132 into which the inwardly disposed piezoactuators 21 and 31 of the ink printer modules 2 and 3 project.

The nozzle plate 11 is regularly toothed in its front region and the tooth gaps form the nozzles 111. Up to 192 nozzles are arranged under one another in this way (FIG. 2 only schematically showing a few such gaps). The nozzles 111 are connected in alternation to the ink chambers 232, 332, 252, and 352 in the ink printer modules 2 and 3. The nozzles 111 are connected to the right side via the openings 121 in the adapter plate 12, the openings 221 in the first cover plate 22, the respective outflow channels 231 and the respective openings 23 in the first intermediate plate 23, the openings 241 in the separating plate 24, and the outflow channels 251 in the second intermediate plate 25. The nozzles 111 are connected to the left side via the openings 131 in the adapter plate 13 to the openings 231 in the first cover plate 32, the respective outflow channels 331 and the respective openings 334 in the first intermediate plate 33, the openings 341 in the separating plate 34, and the outflow channels 351 in the second intermediate plate 35. Adequately large spaces between the neighboring ink chambers and their associated ink channels are achieved in this way.

The openings 121 and 131 in the adapter plates 12 and 13 (also see FIG. 3) each have one region matched to the dimension d (nozzle height) of the nozzles 111 and these respective regions are in registry with the nozzles 111. The openings 121 and 131 each have another region matched to the dimension D (height of the ink connecting channel) of the connecting channels to the ink chambers 232, 252, 332 and 352 and these respective regions are in registry with the chambers 232, 252, 332, 352. In order to achieve ink paths of equal length from the ink chambers 232, 252, 332, 352 to the nozzles, the ink chambers 232 and 332 that lie closer to the nozzle module 11 are set correspondingly farther back from the front side compared to the ink chambers 252, 352 lying farther away. In this case, this corresponds to the sum of the thickness of one of the separating plates 24, 34 and one of the intermediate plates 23, 33.

An ink printer module 2 is composed of a first cover plate 22, having piezoactuators 21 applied thereon, a first intermediate plate 23, a separating plate 24, a second intermediate plate 25, and a second cover plate 26 having piezoactuators 27 applied thereon. Ink chambers 232 are arranged equidistantly under one another between the first cover plate 22 and the separating plate 24, and ink chambers 252 are arranged equidistantly under one another between the second cover plate 26 and the separating plate 24. Here, the ink chambers 232 are formed in the first intermediate plate 23 as elongated openings extending in the direction from the front side to the back side. One wall of each ink chamber 232 is formed by the cover plate 22. Analogously, the ink chambers 252 are formed in the second intermediate plate 25 equidistantly under one another. Here, the cover plate 26 forms a sidewall of the ink chambers 252.

The ink chambers 232 in the first intermediate plate 23 are offset with a mismatch relative to those in the second intermediate plate 25, the acoustic decoupling being reinforced as a result thereof.

Analogously to the ink printer module 2, the ink printer module 3 is composed of a first cover plate 32 having piezoactuators 31 applied to the outside thereof, a first intermediate plate 33, a separating plate 34, a second intermediate plate 35, and a second cover plate 36 with piezoactuators 37 applied to the outside thereof. The arrangement and fashioning of the ink chambers 332 and 352 is analogous to that of the ink printer module 2.

In this way, the outer ink chambers 252 of the ink printer module 2 align with the outer ink chambers 352 of the ink printer module 3 and the inner ink chambers 232 of the ink printer module 2 align with the inner ink chambers 332 of the ink printer module 3.

The piezoactuators 21, 27, 31 and 37 are secured to the respective cover plates 22, 26, 32 and 36 in those regions that lie opposite the ink chambers 232, 252, 332 and 352.

Figure 2A:
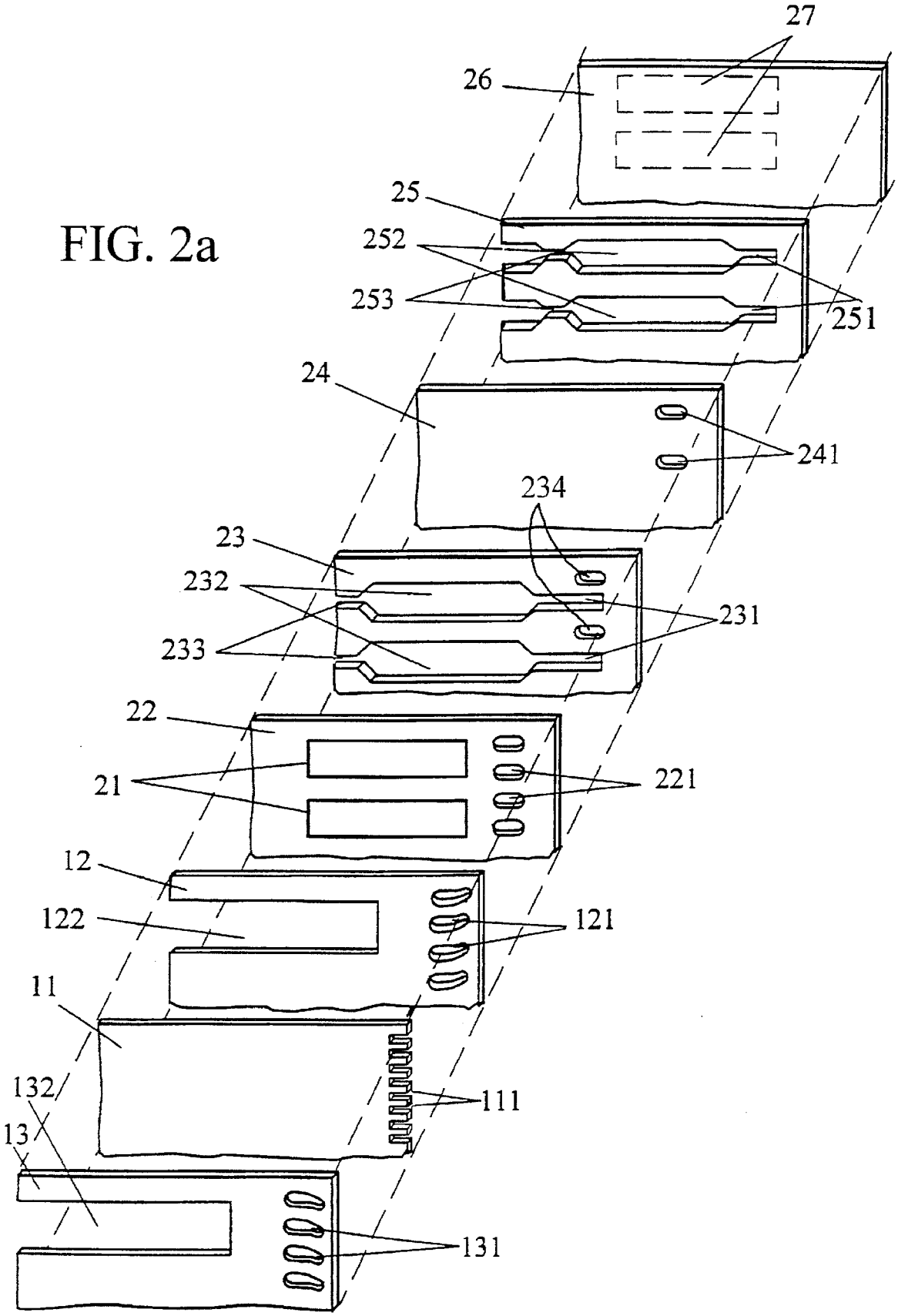
FIG. 2*a* shows the right side of an ink printer head of FIG. 1 in an exploded view.
Figure 2B:
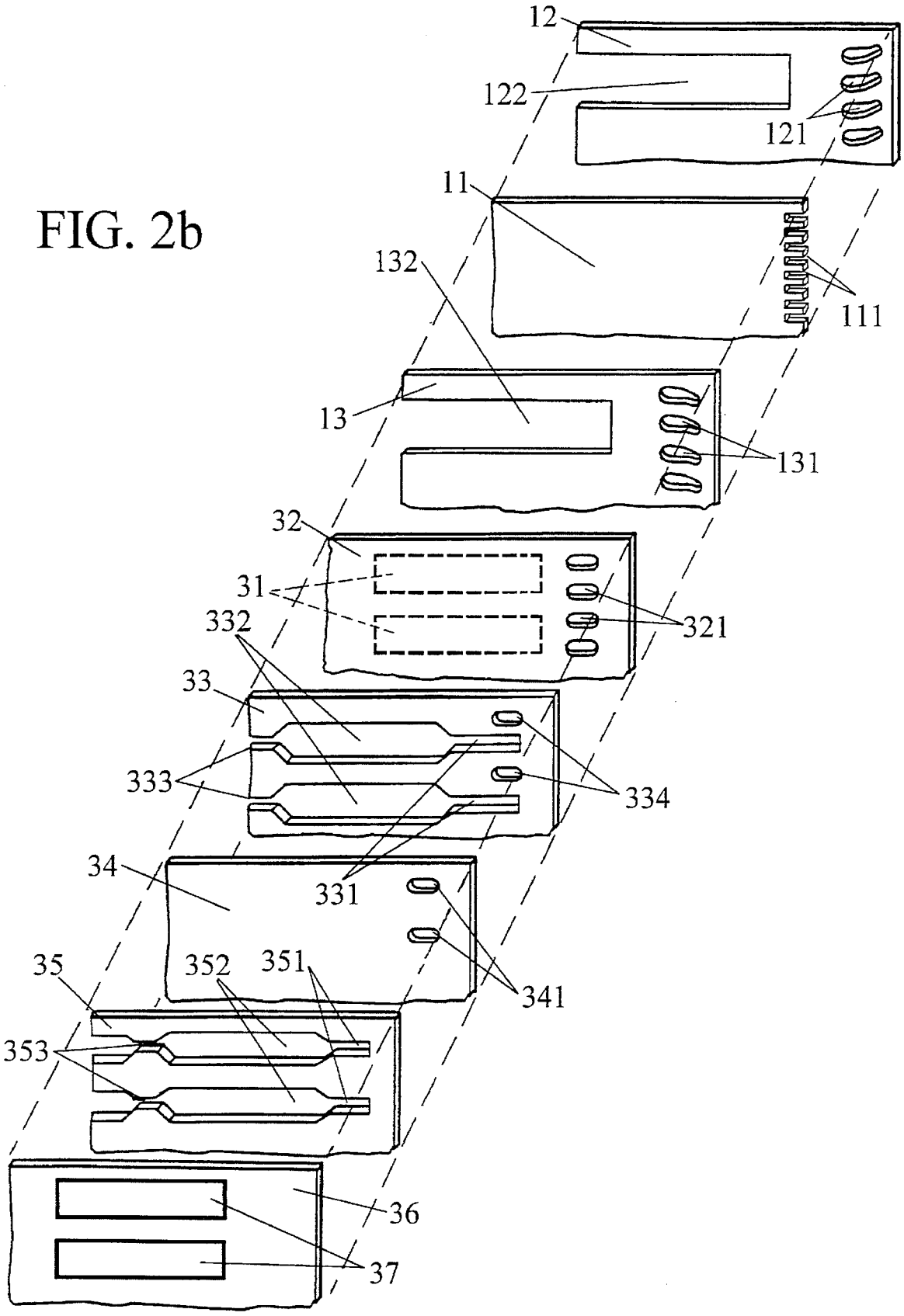
FIG. 2*b* shows the left side.
Figure 3:
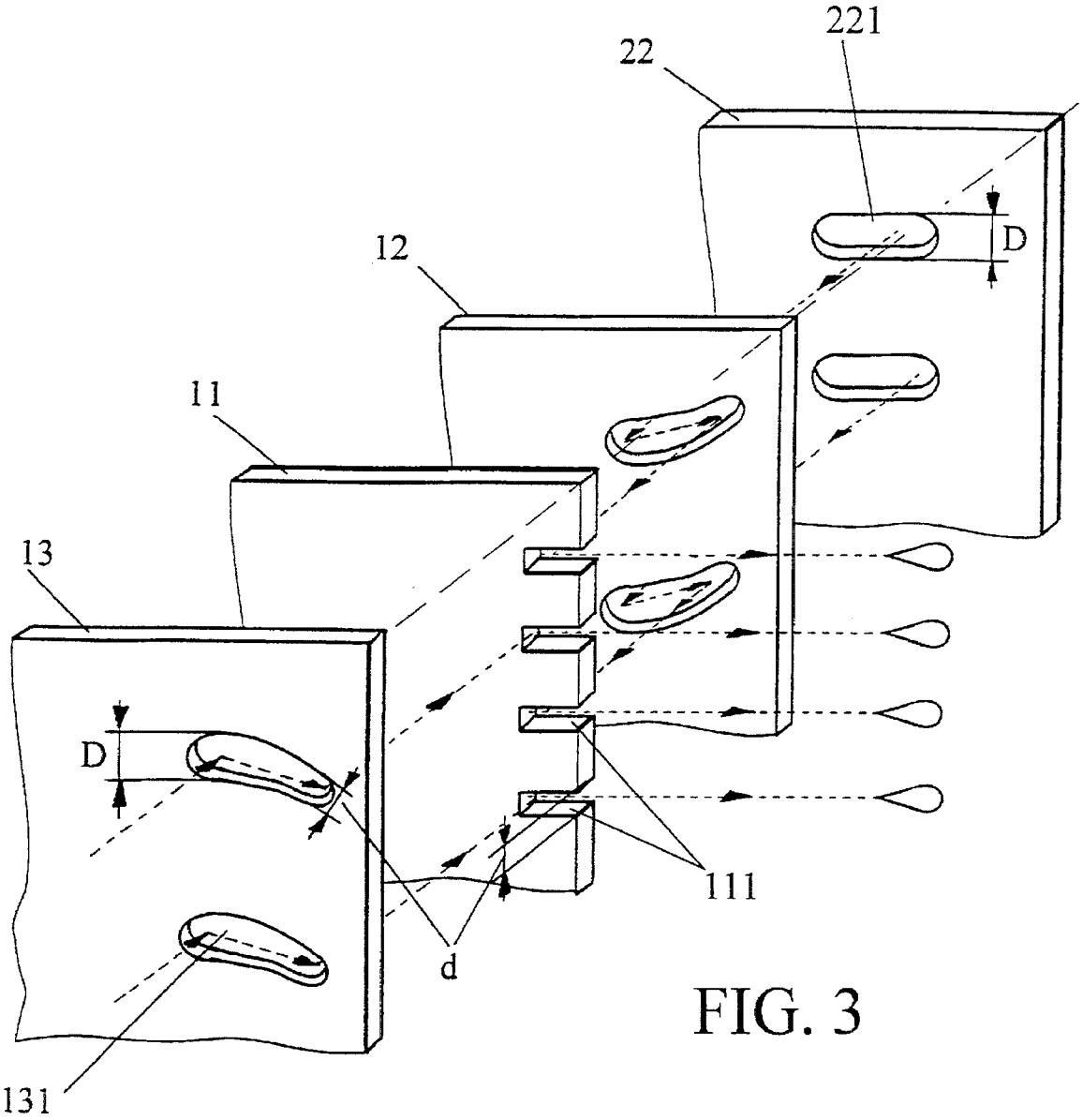
FIG. 3 shows a detail from the nozzle module area, shown schematically in an exploded view.

As can be seen from FIGS. 2 and 3, a pressure pulse generated by a piezoactuator 21 effects a diminution of the volume of the ink chamber 232, causing ink to be expressed through the ink outflow channel 231, through the openings 221 and 121 to the nozzle 111 and, deflected by 90 degrees at the nozzle module 11, the ink departs the nozzle aperture 111 as an ink drop. After the pressure pulse decays, ink is replenished via the ink admission channel 233. The functioning of the other ink pressure chambers is analogous with ink replenishment occurring via admission channel 253.

Figure 4:
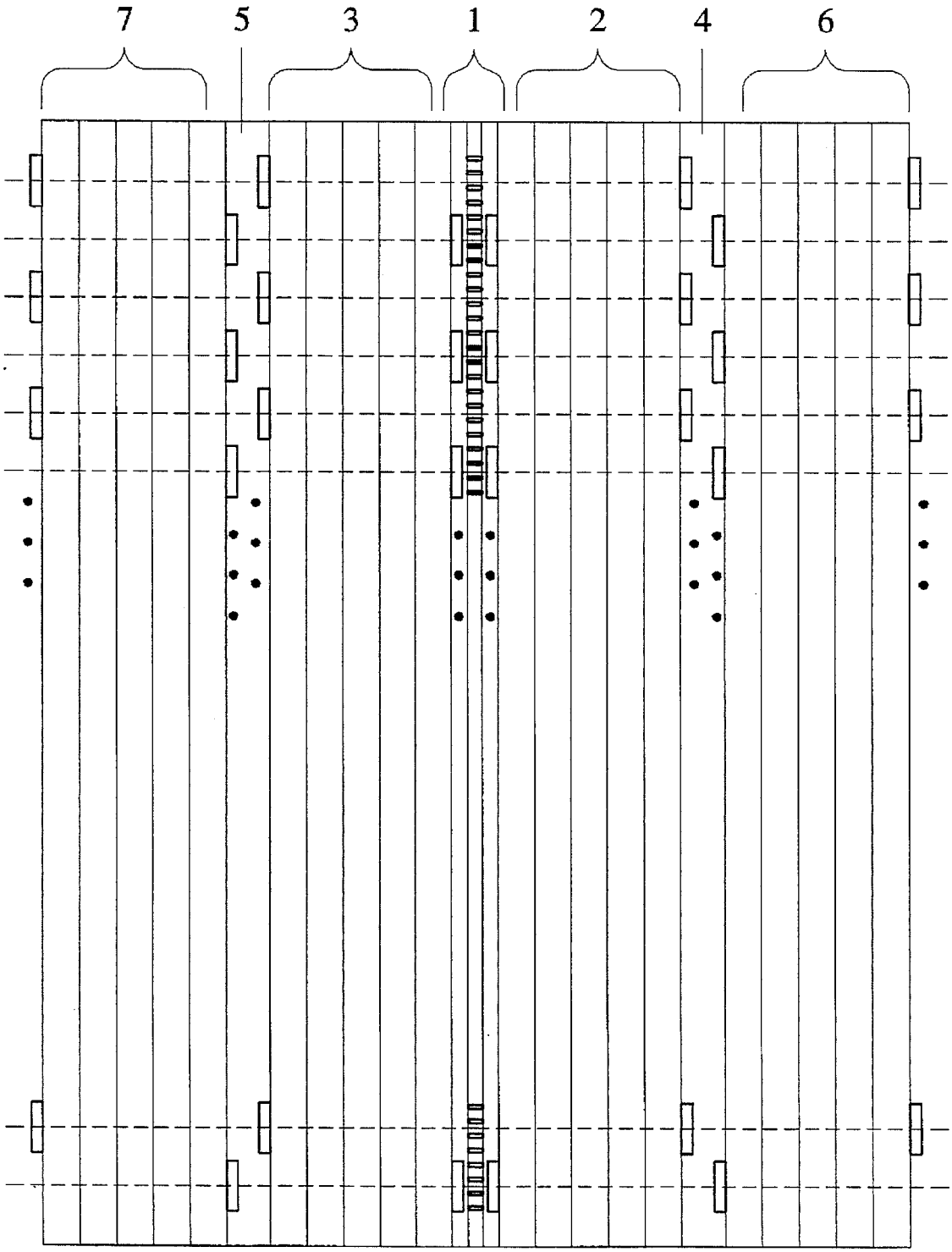
FIG. 4 shows a front view of an ink printer head constructed in accordance with the principles of the present invention composed of one nozzle module and four ink printer modules.

As mentioned above, the nozzle gap, or the allocated plate length can amount to one inch. In order to achieve 192 dpi, two ink printer modules 2, 6, 3 and 7 must respectively be arranged at opposite sides of the nozzle module 1 (see FIG. 4). In this case, spacer plates 4 and 5 are additionally required between the ink printer modules 2 and 6 as well as between the printer modules 3 and 7, these likewise being provided with openings for the ink guidance and with recesses for the piezoactuators.

Figure 5:
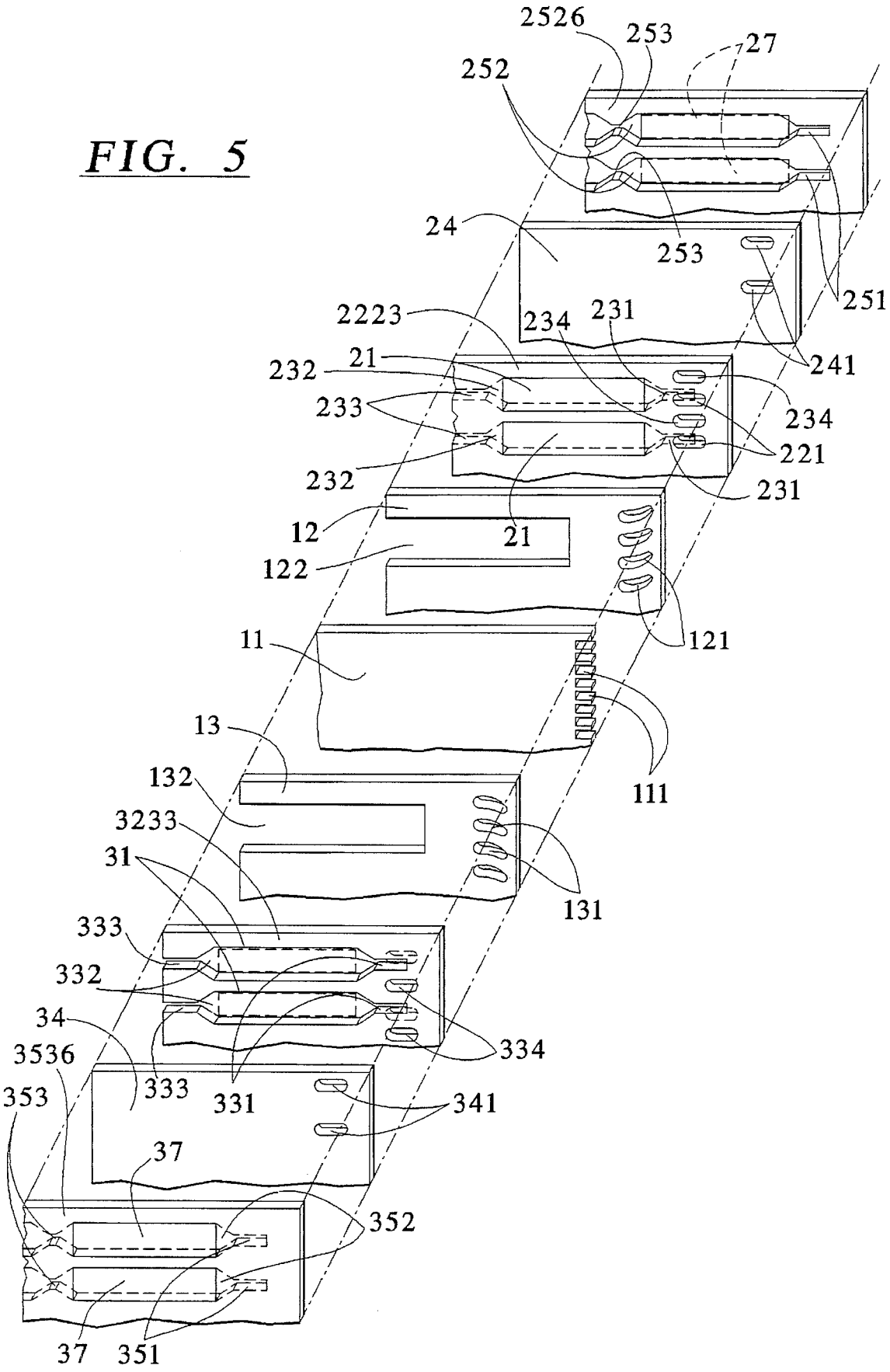
FIG. 5 shows an ink printer head in an exploded view with ink chambers in the cover plates.

The respective recesses 122 and 132 in the adapter plates 12 and 13 expediently extend to the back side, so the piezoactuators 21, and 31 are accessible from this side. The spacer plates are then also analogously fashioned. The nozzle plate 1 can be provided with a recess in the same way for further improving the accessibility. A modified version of the ink printer modules 2 and 3 is shown in FIG. 5. In FIG. 5, the first cover plate 22 and the first intermediate plate 23 are combined into one plate 2223. The second intermediate plate and the second cover plate 26 are combined into one plate 2526. In the same manner, the first cover plate 32 and the first intermediate plate 33 are combined into one plate 3233. The second intermediate plate 35 and the second cover plate 35 are combined into one plate 3536.

Although modifications and changes may be suggested by those skilled in the art, it is the intention of the inventors to embody within the patent warranted hereon all changes and modifications as reasonably and properly come within the scope of their contribution to the art.

We claim as our invention:

1. An ink printer head comprising:

an edge shooter assembly having at least two mirror symmetric ink printer modules and a nozzle module disposed between said at least two mirror-symmetric ink printer modules, said assembly having a front side;

each ink printer module containing a plurality of open volumes respectively forming ink chambers therein and each ink chamber having a piezoactuator associated therewith for forcing a quantity of ink out of the ink chamber associated therewith;

said nozzle module being composed of a nozzle plate and two adapter plates respectively disposed on opposite sides of said nozzle plate so that each adapter plate is adjacent one of said at least two ink printer modules, said nozzle plate having a comb-like edge exposed at said front side of said assembly, said comb-like edge having a plurality of gaps therein forming nozzle apertures, and each adapter plate having openings therein respectively in registration with outlets of the ink chambers in the ink printer module adjacent thereto and recesses therein for the piezoactuators of the adjacent ink printer module; and said nozzle openings formed by said gaps in said comb-like edge of said nozzle plate being disposed equidistantly under one another in a column, and said openings in said adapter plates alternatingly connecting successive nozzle openings in said column to the respective ink chambers of said ink printer modules.

2. An ink printer head as claimed in claim 1 wherein each ink printer module further comprises:

a first cover plate, a first intermediate plate, a separating plate, a second intermediate plate, and a second cover plate;

a first set of said open volumes respectively forming a first set of said ink chambers being disposed equidistantly beneath one another between said first cover plate and said separating plate;

a second set of said open volumes respectively forming a second set of said ink chambers being disposed equidistantly relative to one another between said separating plate and said second cover plate, the ink chambers in said second set being offset in a direction corresponding to said nozzle openings relative to said first set with said first set of ink chambers in one of said at least two ink printer modules being aligned with said first set of ink chambers in the other of said ink printer modules and said second set of ink chambers in said one of said ink printer modules being aligned with said second set of ink chambers in the other of said ink printer modules;

said first cover plate carrying the piezoactuators for the first set of ink chambers between said first cover plate and said separating plate in registration with said first set of ink chambers at a side of said first cover plate facing away from said first intermediate plate;

said second cover plate carrying the piezoactuators for the second set of ink chambers between said second intermediate plate and said second cover plate in registration with said second set of ink chambers at a side of said second cover plate facing away from said second intermediate plate; and said ink chambers in said first set being disposed a larger distance from said front side of said assembly compared to said ink chambers in said second set so that all of the ink chambers in both said first and second sets have ink paths of equal length from each ink chamber to the nozzle opening associated therewith.

3. An ink printer head as claimed in claim 2 wherein said first and second sets of volumes forming said first and second sets of ink chambers are respectively disposed in said first and second intermediate plates.

4. An ink printer head as claimed in claim 2 wherein said first and second sets of volumes forming said first and second sets of ink chambers are respectively disposed in said first and second cover plates.

5. An ink printer head as claimed in claim 1 further comprising additional mirror-symmetric ink printer modules disposed on opposite sides of said nozzle module and a plurality of spacer plates disposed between adjacent ink printer modules, each spacer plate carrying further piezoactuators and having openings therein for guiding ink between adjacent ink printer modules.

6. An ink printer head as claimed in claim 5 wherein said recesses in said adapter plates and the recesses in said spacer plates extend to a backside of said assembly and are accessible at said backside.

7. An ink printer head as claimed in claim 1 wherein said recesses in said adapter plates extended to a backside of said assembly, and are accessible from said backside.

8. An ink printer head as claimed in claim 1 wherein said nozzle plate has recesses therein in registration with said recesses in said adapter plates.

9. An ink printer head as claimed in claim 1 wherein each of said ink chamber outlets has a first dimension and wherein each of said nozzle openings has a second dimension, and wherein said openings in each of said adapter plates have a first region having said first dimension and a second region having said second dimension, each opening in said adapter plate being disposed with said first region in registration with an ink chamber outlet and said second region disposed in registration with a nozzle opening for that ink chamber.

* * * * *